United States Patent [19]

Aso et al.

[11] Patent Number: 4,712,493

[45] Date of Patent: Dec. 15, 1987

[54] BUTTON SEWING MACHINE

[75] Inventors: Hideo Aso, Chofu; Hirohisa Fujino, Yamatotakada; Seiichi Saibe, Kashihara, all of Japan

[73] Assignee: Tokyo Juki Industrial Co., Ltd., Tokyo, Japan

[21] Appl. No.: 55,784

[22] Filed: May 29, 1987

[30] Foreign Application Priority Data

May 30, 1986 [JP] Japan ..... 61-126673

[51] Int. Cl.[4] ..... D05B 3/14

[52] U.S. Cl. ..... 112/112; 112/121.12

[58] Field of Search ..... 112/112, 110, 111, 113, 112/114, 115, 104, 108, 121.12

[56] References Cited

U.S. PATENT DOCUMENTS 3,680,506 8/1972 Albrecht et al. ..... 112/112
4,134,350 1/1979 Dancso et al. ..... 112/110
4,436,041 3/1984 Taddicken ..... 112/110
4,501,207 2/1985 Miyazaki et al. ..... 112/121.12 X

FOREIGN PATENT DOCUMENTS 45-13643 6/1970 Japan .

*Primary Examiner*—Peter Nerbun
*Attorney, Agent, or Firm*—Morgan & Finnegan

[57] ABSTRACT

A button sewing machine allows simultaneous sewing of both a stay button and a surface button to a workpiece and conducts button-neck-wrapping by inclining both buttons with a workpiece. A needle is arranged to travel between an upper needle bar spindle and a lower needle bar spindle, being received by each spindle alternately per each needle stroke, such that buttons are sewn in a manner closely simulating "hand" sewing. A worktable is arranged to move in both the X and Y directions in accordance with the button hole pitch distance in synchronization with the up and down motion of the needle.

2 Claims, 35 Drawing Figures

BUTTON SEWING MACHINE

BACKGROUND OF THE INVENTION

The invention relates to sewing machines and more particularly to a button sewing machine. Japanese utility model publication No. 45-13643 shall be referred to in describing the background of this invention. According to publication No. 45-13643, a button is first sewn to a workpiece placed horizontally on a sewing machine. The button is then turned to be positioned vertically, and button-neck-wrapping is then conducted.

However, in such known prior art systems, when a stay button and a surface button are sewn to a thick workpiece such as coat stuff or fitted stuff, it was not possible to sew both the stay button and the surface button by simultaneously placing the surface button at upper side of the stuff and the stay button at lower side of the stuff, and then performing button-neck-wrapping after finishing the button sewing operation.

It is therefore an object of the invention to provide a button sewing machine which allows simultaneous sewing of both a stay button and a surface button.

It is a further object of the invention to provide a button sewing machine which not only allows simultaneous sewing of both a stay button and a surface button but which also allows button-neck-wrapping after finishing the sewing operation.

SUMMARY OF THE INVENTION

These and other objects of the invention are met by providing a button sewing machine comprising a workpiece table arranged to move in both X and Y directions in association with two drive motors, a stay button chucking device located above said workpiece table, a surface button chucking device located above said stay button chucking device, and a button holder which transfers a stay button to the stay button chucking device and a surface button to the surface button chucking device. In operation, a workpiece is placed between the surface button and the stay button. Then, the positions of both buttons are adjusted by moving the workpiece table in the Y direction such that the button holes of both buttons are vertically aligned. Button sewing then starts by moving the workpiece table in both the X and Y directions such that both buttons are sewn simultaneously to the workpiece. The surface button, the workpiece, and the stay button are then inclined by ninety degrees to expose the thread connecting the surface button and the workpiece for button-neck-wrapping. The workpiece table then moves in the X direction synchronously with the up and down motion of the needle and button-neck-wrapping is thereby conducted.

BRIEF DESCRIPTION OF THE DRAWINGS

The invention will be described in greater detail below by way of reference to the following drawings, in which.

DETAILED DESCRIPTION OF THE DRAWINGS

Figure 1:
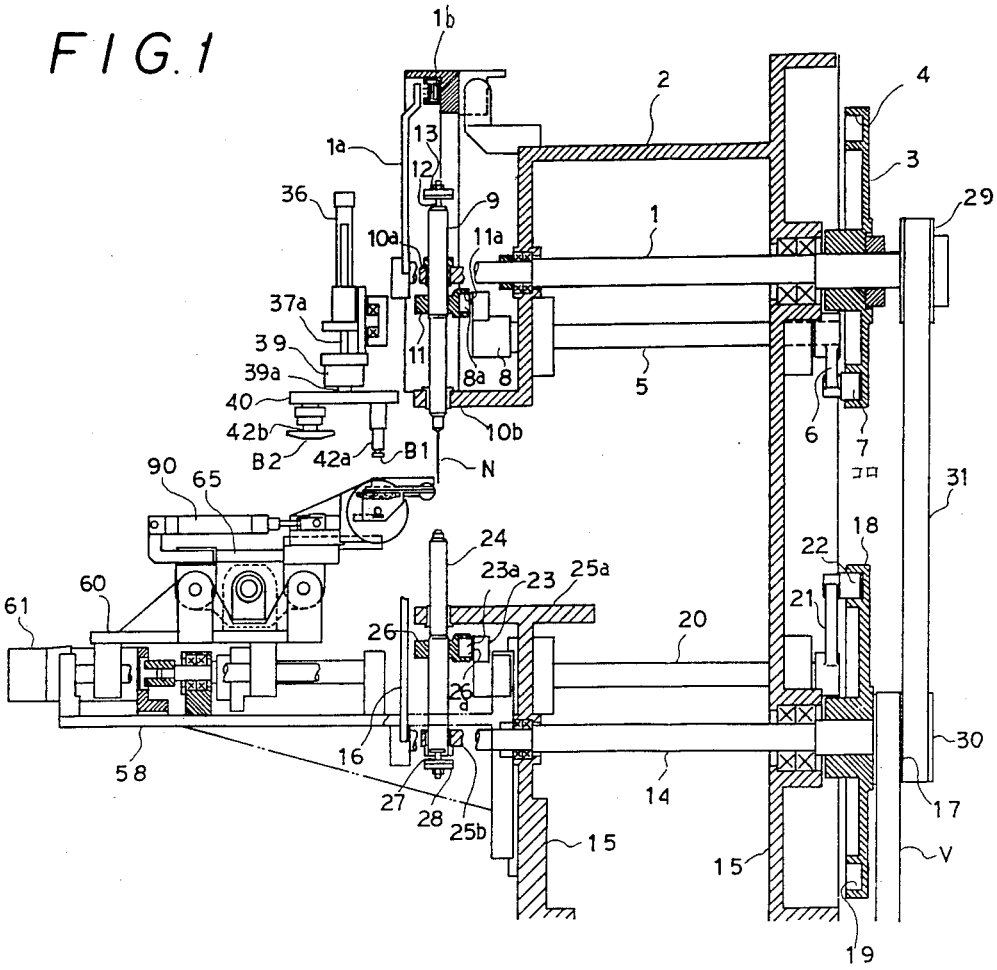
FIG. 1 is a partially sectioned drawing of a button sewing machine according to the invention.

Referring to the accompanying drawings, a preferred embodiment of the invention will now be explained. In the drawings, the letter A denotes a button holding device, the letter B denotes an X-Y table device, the letter C denotes a stay button chucking device, and the letter D denotes a surface button chucking device.

Figure 2:
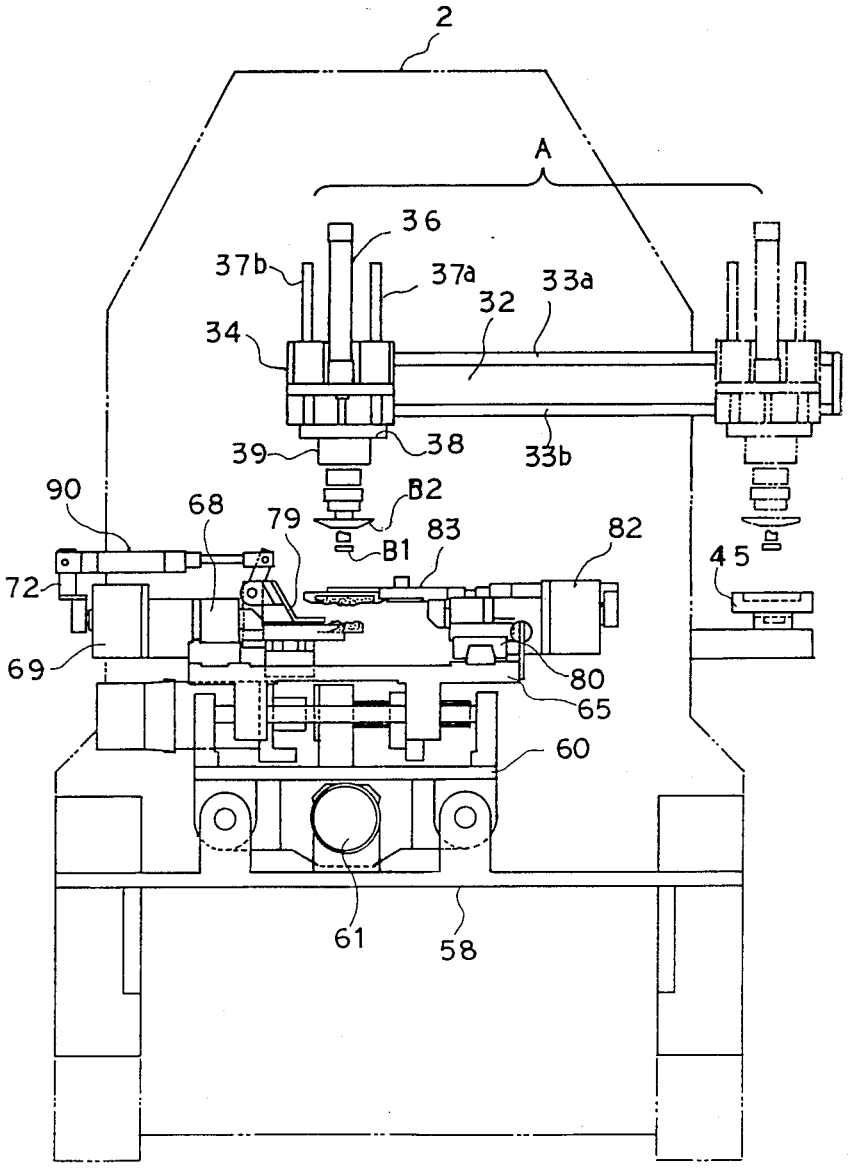
FIG. 2 is a left side view drawing of the embodiment of FIG. 1.

FIG. 1 is a sectional view drawing generally showing a mechanism for traversing a needle between an upper needle bar spindle and a lower needle bar spindle, a button holder which transfers buttons, and a workpiece table which moves in both the X and Y directions. FIG. 2 is a front view drawing of the embodiment of FIG. 1.

First, the mechanism for driving the upper needle bar will be explained. Referring to FIGS. 1 and 2, an upper looper shaft 1 is shown which is rotatably sustained by a frame 2. An upper looper 1*a* is fixed at the left end of the upper looper shaft 1, and the upper looper 1*a* provides a looper thread guide 1*b* at its end. A disc-shaped first-cam-body 3 is fixed to the right end of the upper looper shaft 1. The first-cam body 3 provides a first-groove-cam 4 at its surface. An upper-needle-bar-driving shaft 5 is sustained rotatably by the frame 2.

A first sub-lever 6 is shown in FIG. 1 with its upper end connected to the upper-needle-bar-driving-shaft 5, and its lower end providing a roller 7 which is slidably inserted into the grove-cam 4. An upper-needle-bar-crank-arm 8 has its base end fixed to the upper-needle-bar-driving-shaft 5 and another end providing a slide block 8*a*. An upper needle bar 9 is sustained by machine frame 10*a*, 10*b* to perform the up and down motion. A needle bar connector 11 has one end fixed to the upper needle bar 9. Another end of the connector 11 provides a groove ll*a* in which the slide block 8*a* is slidably inserted.

FIG. 1 also shows a chuck bar 12 for the needle N having its upper end providing an adjustable nut 13. When the chuck bar 12 descends the lower end of the nut 13 touches the upper surface of the metal bushing provided at the machine frame 10*a*, only the upper needle bar 9 goes further down. The chucking device contained in the upper needle bar 9 releases the needle N such that the needle N is transferred or relayed into a lower needle bar spindle which will be explained later.

The lower-needle-bar driving mechanism will next be explained. This mechanism includes a lower looper shaft 14 which is rotatably sustained by the lower frame 15. A lower looper 16 is fixed at the left end of the lower looper shaft 14. The right end of the lower looper shaft 14 fixes a pulley 17. A V-belt loads on the pulley 17. This V-belt may be driven by a servo-motor (not shown).

A disc-shaped second-cam-body 18 is fixed to the right end of the lower looper shaft 14. The second-cam-body 18 provides a second-groove-cam 19 at its surface.

A lower-needle-bar-drive shaft 20 is sustained rotatably by the lower machine frame 15. A second-sub-lever 21 is shown in FIG. 1 having its lower end fixed to the lower-needle-bar-drive-shaft 20 and its upper end providing a roller 22 which is slidably inserted into the second-groove-cam 19.

A lower-needle-bar-crank-arm 23 is provided with its base end fixed to the lower-needle-bar-drive-shaft 20 and another end providing a slide block 23*a*. A lower-needle-bar 24 is sustained by the machine frame 25*a*, 25*b* to perform up and down motion.

FIG. 1 also shows a lower needle bar connector 26 having one end fixed to the lower needle bar 24 and another end providing a groove 26*a* in which the slide block 23*a* is slidably inserted. A chuck bar 27 is also shown having its lower end providing an adjustable nut 28.

When the lower needle bar 25 ascends and the upper surface of the adjustable nut 28 touches the lower end of the metal bushing provided at the machine frame 25*b*, only the needle bar 25 goes up further. The chucking device contained in the lower needle bar 24 thereby releases the needle N such that the needle N is transferred or relayed into the upper needle bar spindle.

Pulleys 29 and 30 are fixed to the upper looper shaft 1 and to the lower looper shaft 14, respectively. A timing belt 31 loads on these pulleys such that the rotation of the lower looper shaft 14 is transmitted to the upper looper shaft 1.

Figure 3:
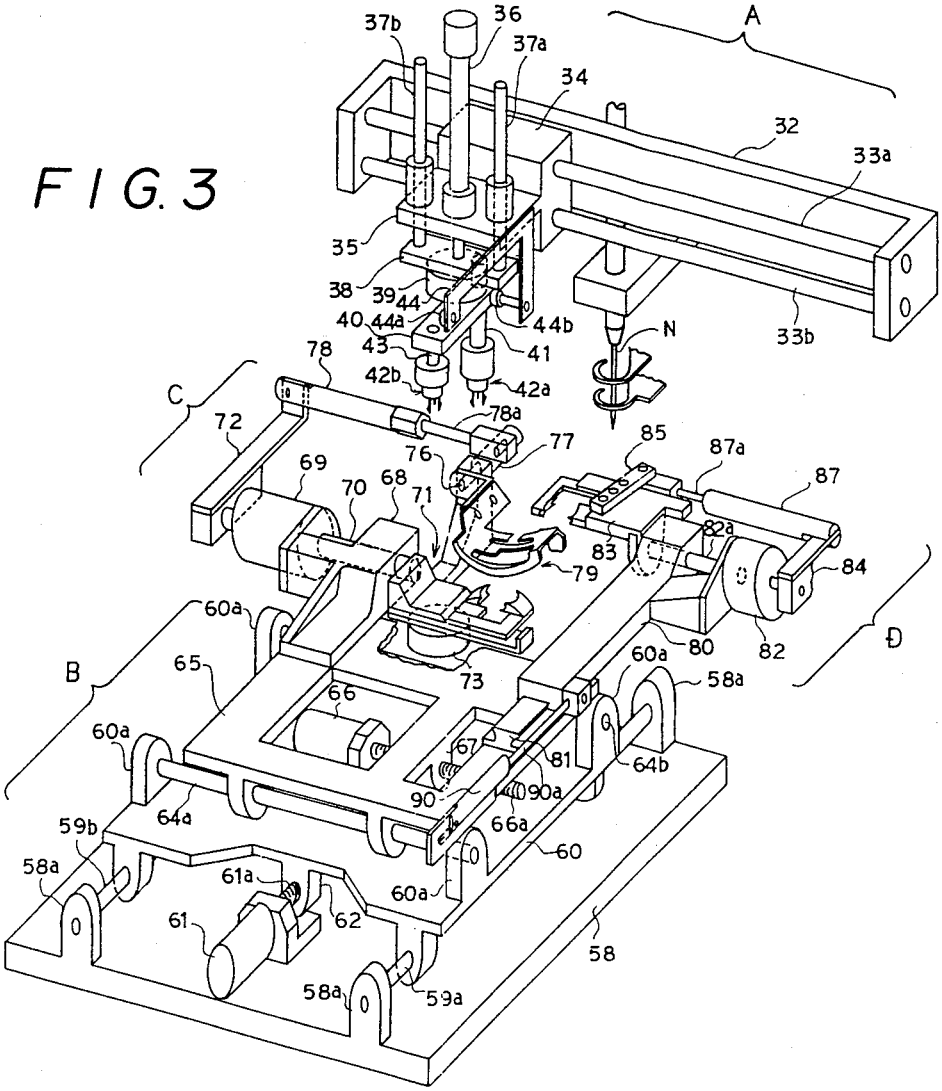
FIG. 3 is a perspective drawing in accordance with one aspect of the invention showning a button holding device A, an X-Y table B, a chucking device C for a stay button, and a chucking device D for a surface button.

Referring to FIGS. 2 and 3, a button holder mechanism A for transferring a surface button and a stay button to surface button jaws and to stay button jaw, respectively, will be explained. FIG. 2 shows a support body 32 supporting guide shafts 33*a* and 33*b* which run in the X direction. A movable body 34 is supported by the guide shafts 33*a*, 33*b* such that it moves in the X direction. This movable body 34 provides an extension 35 (FIG. 3) which is extended in the Y direction. The movable body 34 may move (for example, by an air cylinder (not shown)) between a preliminary position as shown in dotted line in FIG. 2 and a working position as shown in solid line in FIG. 2.

An air cylinder 36 may be positioned vertically at a central portion of the extension 35. The end of the air cylinder provides an up-down plate 38 which moves vertically, guided by two guide bars 37*a*, 37*b*. A rotary air cylinder 39 is shown with its upper surface fixed to the lower surface of the up-down plate 38. A rotary shaft 39*a* of the rotary air cylinder 39 is fixed to a rotary plate 40 (FIG. 1). A stay-button-holder-shaft 41 extends vertically downward from the rotary plate 40 and provides a stay-button-holder 42*a* at its lower end. A surface-button-holder-shaft 43 extends vertically downward from the rotary plate 40 and provides a surface-button-holder 42*b* at its lower end.

An L-shaped stop plate 44 (FIG. 3) is fixed at one end to the right side of the extension 35. Referring to FIG. 3, the left high end of the stop plate 44 provides a stopper 44*a*. The right low end of the extension 35 provides a stopper 44*b*.

Referring to FIG. 2, a button receiver 45 is positioned under the preliminary position of the movable body 34 which is shown in dotted line.

Figure 4:
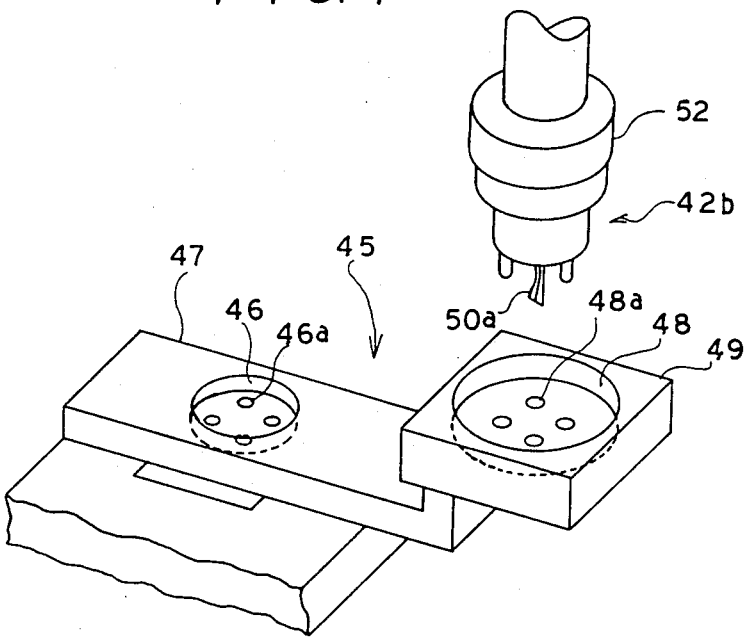
FIG. 4 is a perspective drawing of a button tray.

Referring to FIG. 4, the button receiver 45 comprises two plates. A lower plate 47 receives a stay button B1 at its button tray 46 and a higher plate 49 receives a surface button B2 at its button tray 48. These trays 46, 48 provide pass-through holes which coincide with the button holes when buttons are are placed on these trays. The stay-button-holder 42*a* is designed similarly to the surface-button-holder 42*b*.

Figure 5:
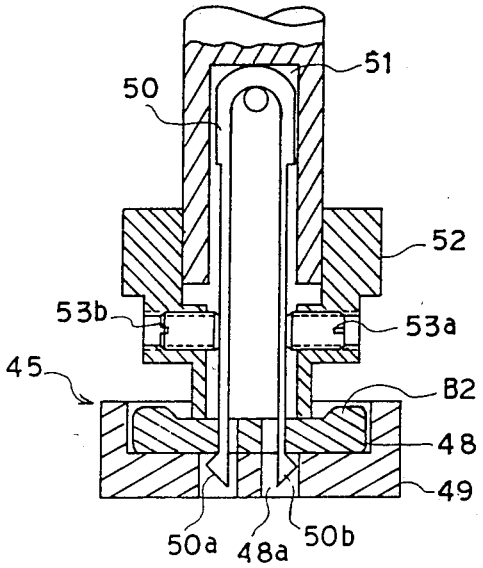
FIG. 5 is a sectional view drawing of a button holder.

Referring to FIG. 5, the button holders 42*a*, 42*b* will now be explained. A U-shaped hold finger 50 is inserted into the inner hole 51 of the surface-button-holder-shaft 43 (FIG. 1) or into the inner hole 51 of the stay-button-holder-shaft 41. The hold finger 50 is made of elastic material and is shaped like a college plier, having two expandable finger tips 50*a*, 50*b* which pierce through button holes diagonally spaced. An adapter 52 is fixed to the lower portion of the surface-button-holder-shaft 43 or the stay-button-holder-shaft 41. Screws 53*a*, 53*b* are screwed in the direction facing to the finger tips 50*a*, 50*b* such that the distance between the two finger tips can be adjusted to meet the button hole spacing by turning the screws 50*a*, 50*b*, respectively.

Referring to FIG. 3, the movement of the workpiece table B in both the X and Y directions will be explained hereafter. A base plate 58 provides four bearings 58*a* at its four corners. Shafts 59*a*, 59*b* running in the Y direction are supported by these bearings 58*a*. A Y-mover 60 is arranged to slide along the shafts 59*a*, 59*b*.

The base plate 58 provides a stepper motor 61 and its shaft provides a feed thread 61*a*. A female thread portion 62 is provided at the bottom of the Y-mover 60 and is fitted to the feed thread 61*a* such that the rotation of the stepper motor 61 causes the Y-mover to move in the Y direction.

The Y-mover 60 provides four bearings 60*a* at its four surface corners. Shafts 64*a*, 64*b*, running in the X direction, are supported by these bearings 60*a*. An X-mover 65 is arranged to slide along the shafts 64*a*, 64*b*.

The Y-mover 60 provides a stepper motor 66 and its shaft provides a feed thread 66*a*. A female thread 67 is provided at the bottom of the X-mover 65 and is fitted to the feed thread 66*a* such that the rotation of the stepper motor 66 causes the X-mover to move in the X direction.

Referring to FIGS. 3 and 6–10, the stay button chucking device C will next be explained. Referring to FIG. 3, numeral 68 denotes a stay button support fixed to the X-mover 60. A rotary air cylinder 69 is fixed to the stay button support 68. A shaft 70 of the rotary air cylinder 69 is slidably sustained by the stay button support 68. A stay button table 71 is fixed to right end of the shaft 70. An air cylinder support body 72 is fixed to the left end of the shaft 70 and a rotary air cylinder 73 is fixed to the bottom of the stay button table 71.

Figure 6:
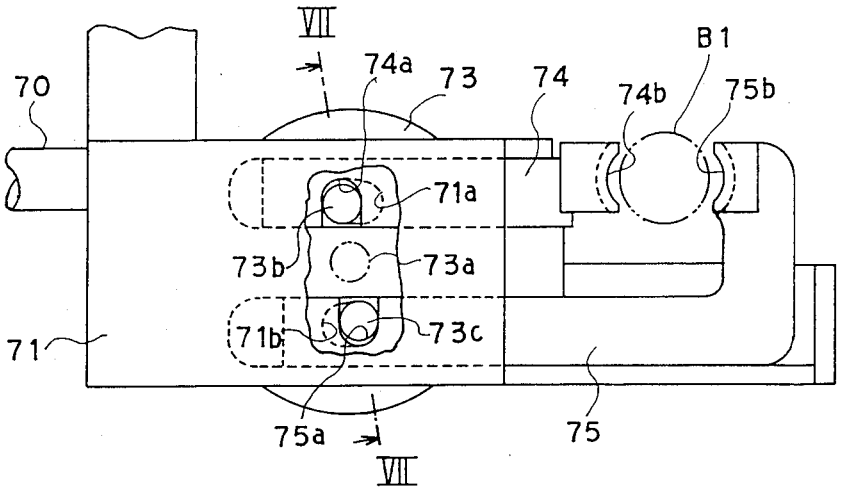
FIG. 6 is a plan view drawing of a stay button table.
Figure 7:
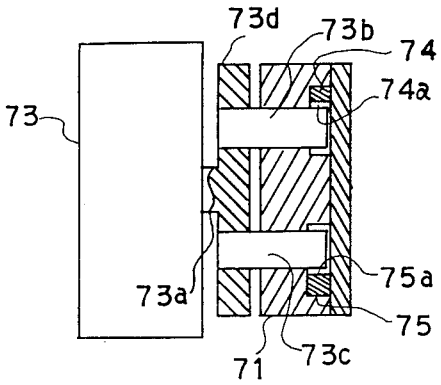
FIG. 7 is a sectional view drawing viewed facing the line VII—VII of FIG. 6.

Referring to FIGS. 6 and 7, a rotary disc 73*d* is shown fixed to a shaft 73*a* of the rotary air cylinder 73. Two projection pins 73*b*, 73*c* project from the rotary disc 73*d* and are inserted slidably into oblong holes 71*a*, 71*b*, respectively. A left jaw 74 for the stay button B1 is slidably sustained by the stay button table 71. A recess 74*a* is provided at left end of the left jaw 74. A left curved jaw 74*b* is provided at right end of the left jaw 74. A right jaw 75 is sustained slidably by the stay button table 71. A recess 75*a* is provided at the left end of the right jaw 75. A pin 73*c* is inserted slidably through the oblong hole 71*b* and the recess 75*a*. A right curved jaw 75*b* is provided at the right end of the right jaw 75.

Referring to FIG. 3, a shaft 76 is rotatably supported to cause a presser foot 79 to rotate and to press down the workpiece. Another end of the shaft 76 provides an arm 77 which contacts a rod 78*a* of an air cylinder 78 which is fixed to a support body 72. Thus, the air cylinder 78 causes the shaft 76 to rotate and to press the workpiece placed on the stay button table 71.

Figure 8:
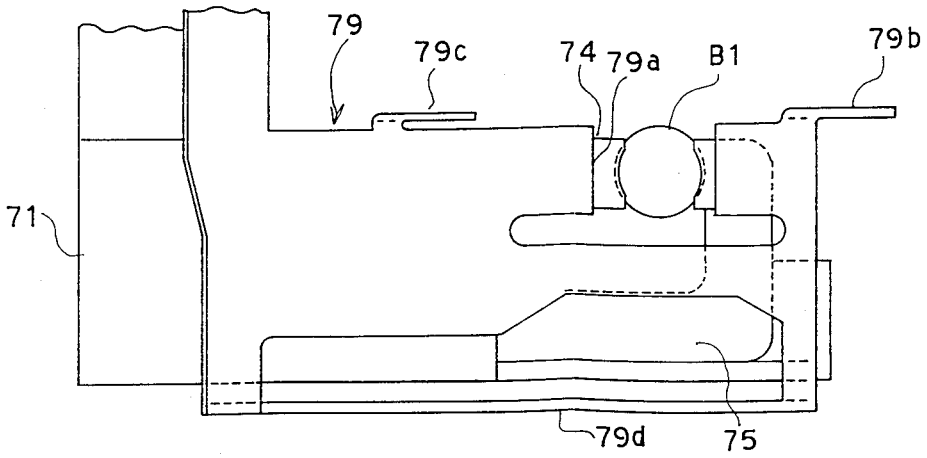
FIG. 8 is a plan view drawing of a stay button table showing a presser foot descended.
Figure 9:
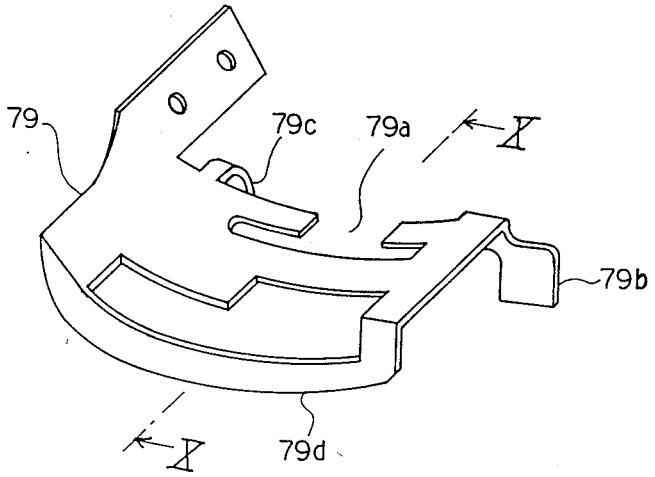
FIG. 9 is a perspective drawing of a presser foot.
Figure 10:
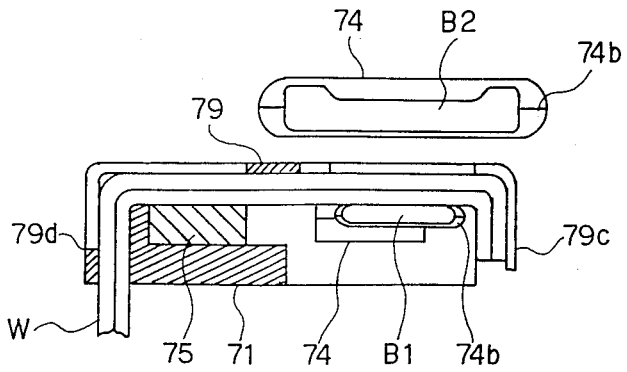
FIG. 10 is a sectional view drawing facing the line X—X of FIG. 9.

Referring to FIGS. 8–10, W denotes a workpiece and 79 denotes a presser foot. The stay button B1 and the surface button B2 are clamped by jaws 74, 75 and are ready for button sewing. Numeral 79*a* denotes an opening space for sewing. The presser foot 79 presses the workpiece W placed on the stay button table 71. Corner bents 79*b*, 79*c* and 79*d* secure the pressing of the workpiece W. When the air cylinder 73 rotates, both the left jaw 74 and right jaw 75 move in parallel but in opposite directions, and thus the left curved jaw 74*b* and the right curved jaw 75*b* perform clamp and release actions. (See FIGS. 6 and 7). The air cylinder 78 causes the presser foot 79 to press or to release the workpiece W. The rotary air cylinder 69 rotates the stay button table 71 vertically such that the stay button and the workpiece are positioned horizontally for button sewing or vertically for button-neck-wrapping.

Figure 11:
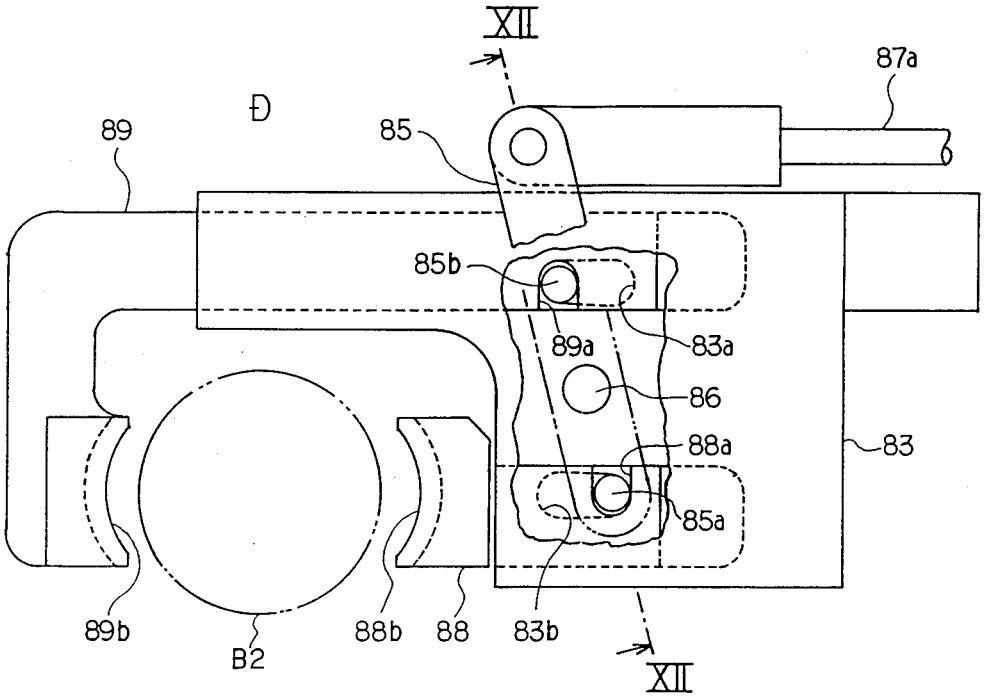
FIG. 11 is a plan view drawing of a surface button plate.
Figure 12:
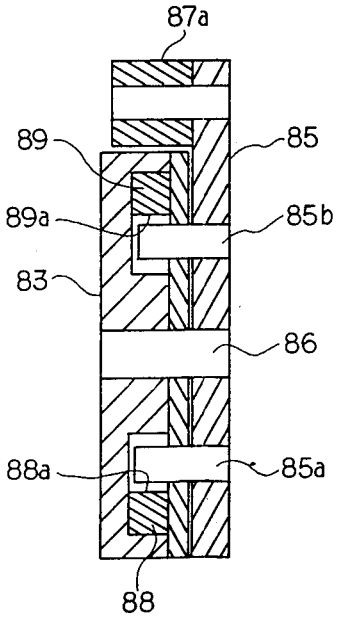
FIG. 12 is a sectional view drawing viewed facing the line XII—XII of FIG. 11.

Referring to FIGS. 3, 11 and 12, the surface button chucking device D will be explained hereafter. A surface-button-table 80 (FIG. 3) is placed on the X-mover 65, and is arranged to slide on a rail 81 in the Y direction. A rotary air cylinder 82 is fixed to the end of the surface-button-table 80. Rotary shaft 82*a* of the rotary air cylinder 82 is slidably sustained by the surface button table 80. The left end of the rotary shaft 82*a* fixes a surface button plate 83 while the right end of the rotary shaft 82*a* fixes an air-cylinder-support 84.

Referring to FIGS. 11 and 12, a rotary plate 85, having two pins 85*a*, 85*b* which penetrate through oblong holes 83*a*, 83*b*, respectively, provided on the surface button plate 83, is rotatably sustained by a shaft 86 located at the mid-center of the two pins 85*a*, 85*b*. One end of the rotary plate 85 is rotatably connected to the end of an air cylinder rod 87*a* of an air cylinder 87 such that the air cylinder 87 causes the rotary plate 85 to rotate around the shaft 86.

A right jaw 88 for the surface button is sustained slidably on the surface button plate 83 and provides a recess 88*a* in which the pin 85*a* is slidably inserted. A right curved jaw 88*b* is fixed to the left end of the right jaw 88. A left jaw 89 for the surface button is sustained slidably on the surface button plate 83, and provides a recess 89*a* in which a pin 85*a* is slidably inserted. A left curved jaw 89*b* is fixed to the left end of the left jaw 89.

Referring to FIG. 3, an air cylinder 90 is fixed to the X-mover 65 and the tip end of an air cylinder rod 90*a* is connected to the surface button table 80. Thereby, the air cylinder 87 causes the rotary plate 85 to rotate and to slide the right jaw 88 and the left jaw 89 horizontally but in opposite directions. Thus, the left curved jaw 89*b* and the right jaw 88*b* clamp or release the surface button B2.

The surface button plate 83 is rotated by the rotary air cylinder shaft 82*a*. Thus, the surface button B2 may be positioned horizontally for button sewing or vertically for button-neck-wrapping. Surface button chucking device D is moved by the air cylinder 90 in the Y direction since the surface button table 80 slides on the rail 81.

The stay button sewing operation will be explained hereafter. Referring to FIG. 2, at first the button holder A is positioned at a preliminaly position as shown in dotted line (right side). Referring to FIG. 4, the stay button B1 is placed on the stay button tray 46, and the surface button B2 is placed on the surface button tray 48. The air cylinder 36 expands, the up-down plate 38 descends and the stay button holder 42*a* and the surface button holder 42*b* descend accordingly.

Referring to FIG. 5, when the finger tips 50*a*, 50*b* penetrate through the button holes, the air cylinder 36 contracts and the up-down plate 38 ascends picking up the stay button B1 and the surface button B2. Referring to FIG. 2, the button holder A then moves from the dotted-line-position to the solid-line-position by the action of an air cylinder (not shown) along the guide shaft 33*a*, 33*b*.

Figure 13A:
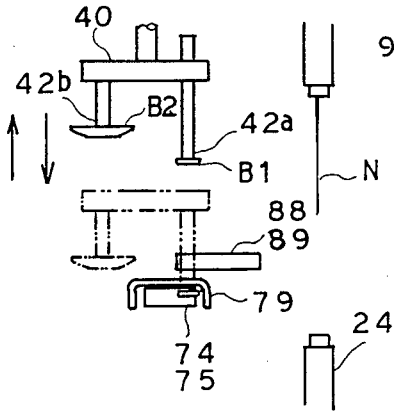
FIGS. 13*a*–13*j* are explanatory drawings illustrating the button sewing process.
Figure 13B:
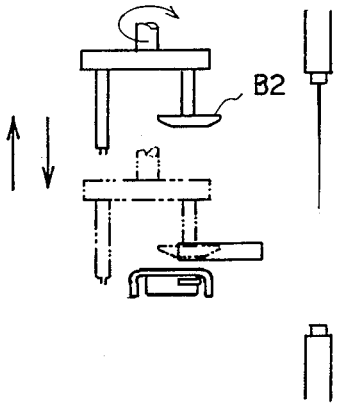

Referring to FIG. 13*a*, in the solid-line-position the stay button holder 42*a* positions the upper side of the left jaw 74 and the right jaw 75. Then, the air cylinder 36 expands, the stay button B1 descends and is positioned between the left curved jaw 74*b* and the right curved jaw 75*b*. Then, the air cylinder 73 rotates clockwise and the stay button B1 is clamped by the left curved jaw 74*b* and the right curved jaw 75*b*. The air cylinder 36 then contracts and the stay button holder 42*a* ascends as is shown in solid line in FIG. 13*a*. The finger tips 50*a*, 50*b* are drawn out from the button holes. Then, referring to FIG. 3, the air cylinder 39 rotates counter-clockwise and the rotary plate 40 rotates by 180 degrees until the upper projected portion of the surface-button-holder-shaft 41 is stopped by the stopper 44*a*. Thus, the surface button B2 is positioned just above the right curved jaw 88*b* and the left curved jaw 89*b*. Then, the air cylinder 36 expands and the surface-button-holder 42*b* descends and is positioned between the right curved jaw 88*b* and the left curved jaw 89*b*. This position of the stay-button-holder 42*a* and the surface-button-holder 42*b* is shown in dotted line in FIG. 13*b*.

Figure 13C:
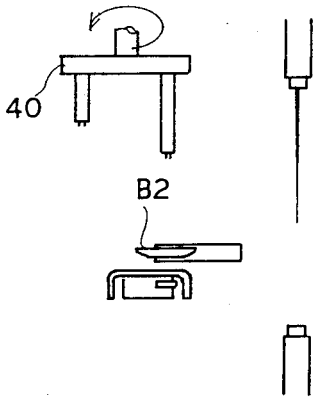

Then, referring to FIG. 11, the air cylinder 87 contracts and the rotary plate 85 rotates clockwise around the shaft 86. As a result, the surface button B2 is clamped by the right curved jaw 88*b* and the left curved jaw 89*b*. Then, the air cylinder 36 contracts and the surface button holder 42*b* moves up and is positioned as shown in solid line in FIG. 13*b*. The finger tips 50*a*, 50*b* are drawn out from button holes. Then, the air cylinder 39 rotates clockwise and the rotary plate 40 rotates by 180 degrees until the side of rotary plate 40 is stopped by the stopper 44*b*. This condition is shown in FIG. 13*c*.

Figure 13D:
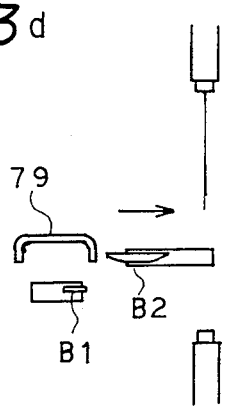
Figure 13E:
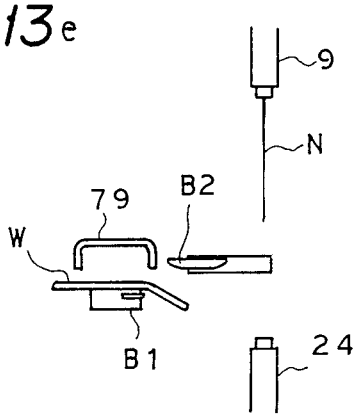

Then, the button holding device A is moved rightwardly along the guide shaft 33*a*, 33*b* to be positioned at the original (preliminary) position as shown in the dotted line in FIG. 2. Then, referring to FIG. 3, the air cylinder 90 expands and the surface button table 80 slides on the rail 81 a short distance backwards in the Y direction. Thus, the curved jaws holding the surface button B2 are positioned as shown in FIG. 13*d*. Then, the workpiece W is placed on the left curved jaw 74*b* and the right curved jaw 75*b* as shown in FIG. 13*e*.

Figure 13F:
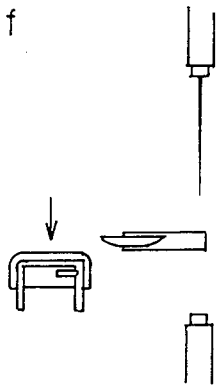
Figure 13G:
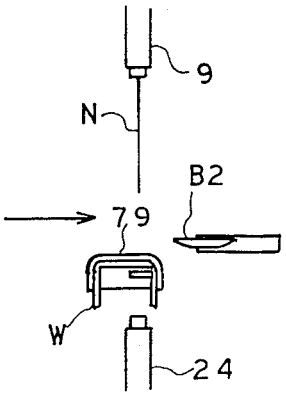

The air cylinder 78 next expands, the presser foot 79 descends and the workpiece W is pressed and bent by corner 79*b*, 79*c*, 79*d* as shown in FIG. 13*f*. The stepper motor 61 then rotates and the Y-mover 60 and the X-mover 65 move in the Y direction backwardly until the stay button B1 is positioned just under the needle N. This position is shown in FIG. 13*g*.

Figure 13H:
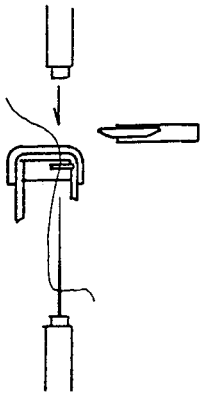

Then, referring to FIG. 1, the sewing machine starts. The upper-needle-bar-drive-shaft 5, the lower-needle-bar-drive-shaft 20, the upper looper shaft 1 and the lower looper shaft are driven by the timing belt 31. The needle descends passing through the workpiece W and the stay button hole and enters into the lower needle bar spindle 24. When the needle enters into the lower-needle-bar-spindle 24, the needle N is firmly chucked by the lower needle bar spindle 24 and simultaneously the upper needle bar spindle releases the needle N. Thus, the needle N is drawn downwardly out from the stay button B1, this condition being shown in FIG. 13*h*.

Figure 13J:
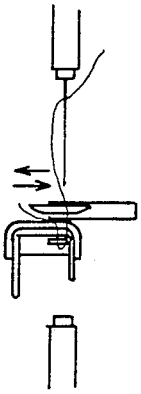
Figure 13I:
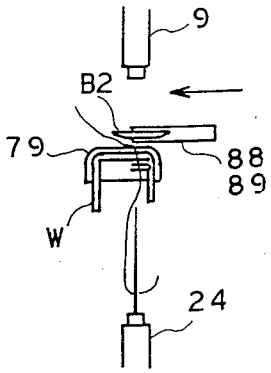

Next, referring to FIG. 3, the air cylinder 90 contracts and the surface-button-table 80 slides forward on the rail 81. The surface button B2 is thus positioned just above the stay button B1. This condition is shown in FIG. 13i.

Figure 15:
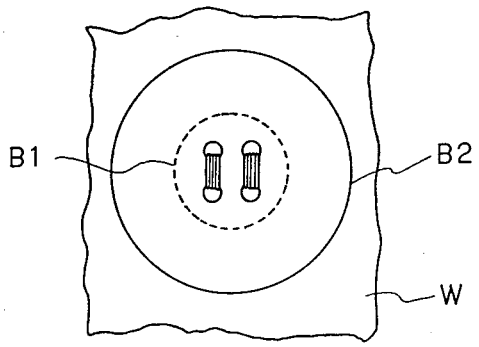
FIG. 15 is a plan view drawing of a surface button after completion of sewing.
Figure 16:
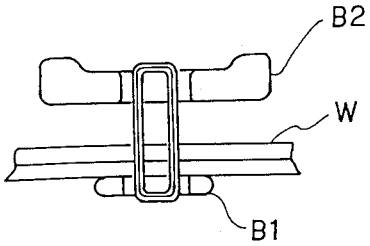
FIG. 16 is a sectional view drawing of button sewing without button-neck-wrapping.

Then, referring to FIG. 3, the stepper motors 61, 62 rotate alternately clockwise and counter-clockwise by a predetermined rotation such that the Y-mover 60 and the X-mover 65 move reciprocally the same distance as the button hole pitch. Thus, the buttons are sewn to the workpiece as shown in FIG. 15 and 16. This condition is shown in FIG. 13*j*.

Figure 14A:
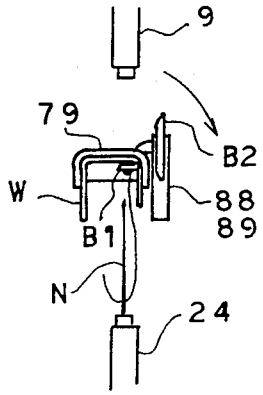
FIGS. 14*a*–14*i* are explanatory drawings illustrating the button-neck-wrapping process.
Figure 14B:
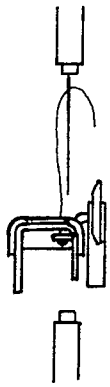

Next, the surface button plate 83 is rotated 90 degrees by the rotary air cylinder 82, this condition being shown in FIG. 14*a*. The needle N then ascends and is chucked by the upper-needle-bar spindle 9 and the button sewing operation is finished except for the button neck wrapping, this such condition being shown in FIG. 14*b*.

Figure 14C:
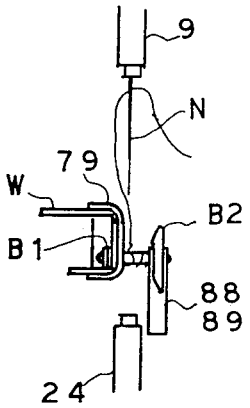
Figure 17:
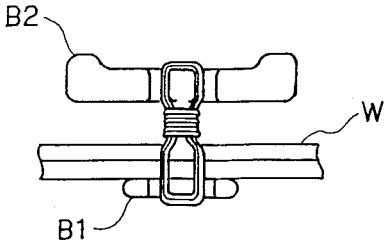
FIG. 17 is a sectional view drawing of button sewing with button-neck-wrapping.

To perform the button-neck-wrapping further, the rotary air cylinder 69 rotates by 90 degrees, the stay-button-table 71 and the presser foot 79 are rotated by 90 degrees, and the thread is exposed between the surface button B2 and the workpiece W. This condition is shown in FIG. 14*c*. Then, the stepper motor 66 rotates a predetermined number of rotations clockwise and counter-clockwise alternately in synchronization with the sewing motion such that the surface button B2 and the stay button B1 move left and right in the X direction while the needle travels around the thread exposed between the surface button B2 and the workpiece W. Thus, button-neck-wrapping is performed as shown in FIG. 17.

During the last several movements of the button-neck-wrapping, the stepper motor moves slightly to cause the needle N to penetrate through the button-neck-wrapped portion such that the back tacking is performed at the final stage of button-neck-wrapping process. Then, the air cylinder 87 expands and the right jaw 88 and left jaw 89 release the surface button B2.

Figure 14D:
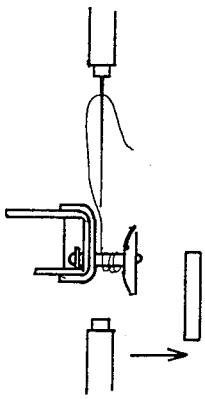
Figure 14E:
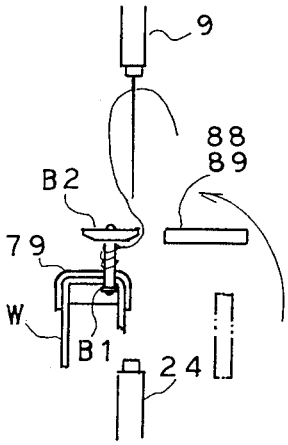
Figure 14F:
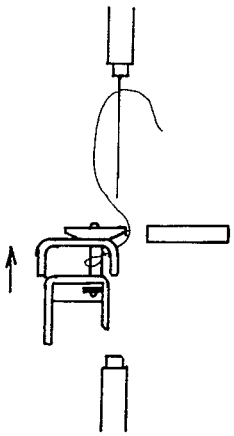

Referring to FIG. 14*d* the air cylinder 90 next expands and the right jaw 88 and left jaw 89 move rightward. Then, referring to FIG. 3, the rotary air cylinders 69, 82 rotate counter-clockwise, and the stay button B1 and the surface button B2 are positioned as shown in FIG. 14*e*. Then, the air cylinder 78 contracts to raise the presser foot 79, and the rotary air cylinder 73 rotates counter-clockwise to release the stay button B1, such condition being shown in FIG. 14*f*.

The workpiece W may then be taken out to the right. Thus, the stay button B1 and the surface button B2 are sewn to the workpiece with button-neck-wrapping finished as shown in FIG. 17.

Figure 14G:
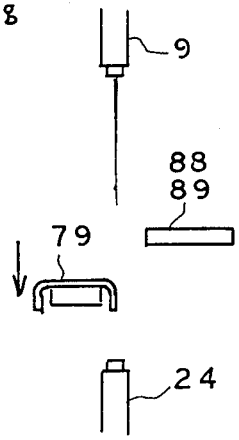
Figure 14H:
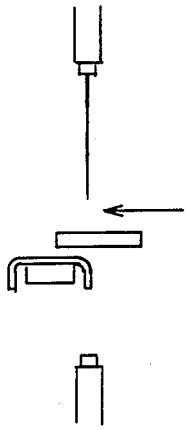
Figure 14I:
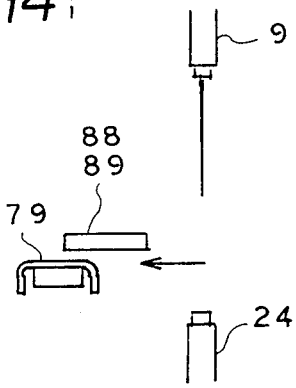

Then the cylinder 78 expands and the presser foot 79 descends. This condition is shown in FIG. 14*g*. Then, referring to FIG. 3, the air cylinder 90 contracts and the surface button table 80 moves frontwardly, the right jaw 88 and the left jaw 89 being positioned as shown in FIG. 14*h*. Then, referring to FIG. 3, the stepper motor 61 rotates to move the Y-mover and the X-mover forward. Thus, the left jaw 74 and the right jaw 75 for the stay button resume their original position as shown in FIG. 14*i* and in FIG. 13*a*. Thus, one cycle of button sewing is completed.

Figure 18:
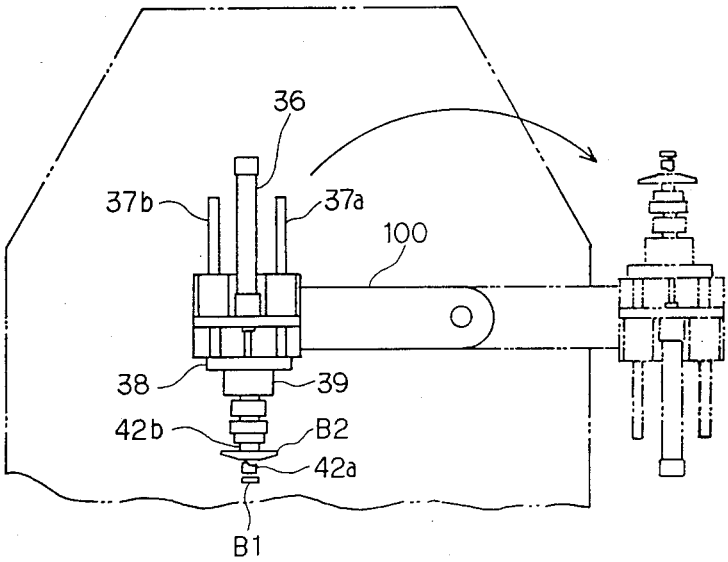
FIG. 18 is a front view drawing of a button holder according to a further embodiment of the invention.

In the preferred embodiment, the movable body 34 which transfers the stay button B1 and the surface button B2 to the workpiece is designed to travel linearly and horizontally. However, the movable body 34 can be designed to rotate to transfer the stay button B1 and the surface button B2 to the workpiece as shown in FIG. 18. Referring to FIG. 18, numeral 100 denotes a rotary arm and its end is rotatably pivoted to the frame 2. Another end of the rotary arm 100 supports the movable body 34 which comprises the same parts as shown in FIG. 3. The rotary arm 100 is rotatable over an angle range of 180 degrees. The dotted line shows the preliminary position and the solid line shows the working position. The stay button and the surface button are taken from each button tray by rotating the rotary arm 100 by 180 degrees to the working position.

As aforementioned, according to the invention, the surface button is sewn to the first side of the workpiece and the stay button is sewn to the back side of the workpiece simultaneously. Thus, buttons are sewn neatly even where the workpiece is a coat stuff of a coarsely woven knitted stuff. Button-neck-wrapping can also be performed.

As many apparently widely different embodiments of the invention may be made without departing the spirit and scope therein, it is to be understood that the invention is not limited to the specific embodiments herein descirbed, but is to be interpreted only in accordance with the appended claims.

What is claimed is:

1. In a button sewing machine having a needle which is provided with the predetermined length of thread for button sewing and travels between an upper needle bar spindle and a lower needle bar spindle being received by each spindle alternately per each needle stroke such that a button is sewn in a manner simulating hand sewing, a button sewing machine comprising:

a movable table which moves in X and Y directions by operation of two motors, a stay button chucking device placed on said movable table, a surface button chucking device placed on said movable table, a button holding device which transfers both a stay button and a surface button to said stay button chucking device and to said surface button chucking device, respectively, said button sewing machine adapted to clamp said stay button and said surface button by said stay button chucking device and said surface button chucking device, respectively, and being adapted to place a workpiece and keep button holes in axial alignment, and to sew the stay button and the suface button simultaneously while moving said movable table in X and Y direction.

2. In a button sewing machine as described in claim 1, said sewing machine being further adapted to rotate said stay button chucking device and said surface button chucking device from horizontal position to a vertical position and to move said movable table in an X direction to conduct button-neck-wrapping around a thread connecting the surface button and the workpiece.

* * * * *

UNITED STATES PATENT AND TRADEMARK OFFICE

CERTIFICATE OF CORRECTION

PATENT NO. : 4,712,493

DATED : December 15, 1987

INVENTOR(S) : Aso et al.

It is certified that error appears in the above-identified patent and that said Letters Patent is hereby corrected as shown below: On the title page In the Assignment Data, after "Tokyo Juki Industrial Co., Ltd., Tokyo, Japan" add --; Takatori Machinery Manufacturing Co., Ltd., Nara Pref., Japan--.

Signed and Sealed this

Nineteenth Day of July, 1988

*Attest:*

DONALD J. QUIGG

*Attesting Officer*

*Commissioner of Patents and Trademarks*